US008864340B2

(12) United States Patent
Holland et al.

(10) Patent No.: US 8,864,340 B2
(45) Date of Patent: Oct. 21, 2014

(54) LOW PROFILE LIGHT HAVING CONCAVE REFLECTOR AND ASSOCIATED METHODS

(71) Applicant: Lighting Science Group Corporation, Satellite Beach, FL (US)

(72) Inventors: Eric Holland, Indian Harbour Beach, FL (US); Mark P. Boomgaarden, Satellite Beach, FL (US); Rick LeClair, Melbourne, FL (US); David DeVerter, Indialantic, FL (US)

(73) Assignee: Lighting Science Group Corporation, Satellite Beach, FL (US)

( * ) Notice: Subject to any disclaimer, the term of this patent is extended or adjusted under 35 U.S.C. 154(b) by 131 days.

(21) Appl. No.: 13/676,539

(22) Filed: Nov. 14, 2012

(65) Prior Publication Data

US 2013/0120963 A1 May 16, 2013

Related U.S. Application Data

(63) Continuation-in-part of application No. 13/476,388, filed on May 21, 2012, now Pat. No. 8,672,518, which (Continued)

(51) Int. Cl.
*F21V 29/00* (2006.01)
*F21V 23/02* (2006.01)

(Continued)

(52) U.S. Cl.
CPC ..... *F21V 7/0066* (2013.01); *F21Y 2103/022* (2013.01); *F21V 29/2212* (2013.01); *F21V 23/026* (2013.01); *F21V 23/04* (2013.01); *F21V 7/0008* (2013.01); *F21S 8/026* (2013.01); *F21Y 2113/005* (2013.01); *F21S 8/04* (2013.01); *F21V 5/00* (2013.01); *F21V 13/04* (2013.01); *F21V 15/01* (2013.01); *F21V 21/04* (2013.01); *F21V 23/0471* (2013.01); *F21V 21/02* (2013.01); *F21V 9/08* (2013.01); *F21V 29/22* (2013.01); *F21V 29/004* (2013.01); *F21Y 2101/02* (2013.01); *F21V 23/002* (2013.01)

USPC ..... 362/294; 362/147; 362/148; 362/249.1; 362/365

(58) Field of Classification Search
CPC ..... F21V 29/00; F21V 29/002
USPC ..... 362/294, 147, 148, 150, 35, 373
See application file for complete search history.

(56) References Cited

U.S. PATENT DOCUMENTS 6,290,382 B1 9/2001 Bourn et al.
6,370,168 B1 4/2002 Spinelli (Continued)

FOREIGN PATENT DOCUMENTS

EP 1950491 7/2008
WO WO2008137732 11/2008

OTHER PUBLICATIONS

EP International Search Report for Application No. 10174449.8; (Dec. 14, 2010).

(Continued)

*Primary Examiner* — Ali Alavi
(74) *Attorney, Agent, or Firm* — Mark R. Malek; Daniel C. Pierron; Zies Widerman & Malek

(57) ABSTRACT

A luminaire to be carried by a lighting fixture. The luminaire may include a housing, a primary optic disposed within the housing having a reflective inner surface defining an optical chamber, a light source, and a heat sink defining an aperture through which light may propagate. The light source may include a plurality of light-emitting diodes (LEDs). The luminaire may further include a secondary optic positioned adjacent to the light source that may collimate and/or refract light emitted by the light source, and may form a seal between the light source and the optical chamber. The luminaire may further include a color conversion layer configured to change the color of light emitted by the light source.

20 Claims, 4 Drawing Sheets

Related U.S. Application Data is a continuation-in-part of application No. 12/775,310, filed on May 6, 2010, now Pat. No. 8,201,968.

(60) Provisional application No. 61/248,665, filed on Oct. 5, 2009.

(51) Int. Cl.

| | |
|---|---|
| ***F21V 23/04*** | (2006.01) |
| ***F21V 7/00*** | (2006.01) |
| ***F21S 8/02*** | (2006.01) |
| ***F21S 8/04*** | (2006.01) |
| ***F21V 5/00*** | (2006.01) |
| ***F21V 15/01*** | (2006.01) |
| ***F21V 9/08*** | (2006.01) |
| ***F21V 23/00*** | (2006.01) |
| *F21Y 103/02* | (2006.01) |
| *F21Y 113/00* | (2006.01) |
| *F21V 13/04* | (2006.01) |
| *F21V 21/04* | (2006.01) |
| *F21V 21/02* | (2006.01) |
| *F21Y 101/02* | (2006.01) |

(56) References Cited

U.S. PATENT DOCUMENTS

| | | | | |
|---|---|---|---|---|
| 6,431,728 | B1 * | 8/2002 | Fredericks et al. | 362/244 |
| 6,542,671 | B1 | 4/2003 | Ma et al. | |
| 6,719,446 | B2 * | 4/2004 | Cao | 362/547 |
| 6,893,140 | B2 | 5/2005 | Storey et al. | |
| 6,945,672 | B2 | 9/2005 | Du et al. | |
| 7,306,352 | B2 | 12/2007 | Sokolov et al. | |
| 7,344,280 | B2 | 3/2008 | Panagotacos et al. | |
| 7,906,722 | B2 | 3/2011 | Fork et al. | |
| 8,038,314 | B2 | 10/2011 | Ladewig | |
| 8,201,968 | B2 | 6/2012 | Maxik et al. | |
| 8,272,763 | B1 | 9/2012 | Chinnam et al. | |
| 8,297,798 | B1 | 10/2012 | Pittman et al. | |
| 2002/0151941 | A1 | 10/2002 | Okawa et al. | |
| 2005/0033119 | A1 | 2/2005 | Okawa et al. | |
| 2007/0041167 | A1 | 2/2007 | Nachi | |
| 2008/0037255 | A1 * | 2/2008 | Wang | 362/294 |
| 2008/0170398 | A1 | 7/2008 | Kim | |
| 2008/0232116 | A1 | 9/2008 | Kim | |
| 2009/0086474 | A1 * | 4/2009 | Chou | 362/230 |
| 2009/0141506 | A1 * | 6/2009 | Lan et al. | 362/351 |
| 2011/0205738 | A1 | 8/2011 | Peifer et al. | |
| 2012/0002411 | A1 | 1/2012 | Ladewig | |
| 2012/0051041 | A1 | 3/2012 | Edmond et al. | |
| 2012/0106144 | A1 | 5/2012 | Chang | |
| 2012/0201034 | A1 | 8/2012 | Li | |
| 2012/0262902 | A1 | 10/2012 | Pickard et al. | |
| 2012/0262921 | A1 | 10/2012 | Boomgaarden et al. | |
| 2012/0327650 | A1 | 12/2012 | Lay et al. | |
| 2013/0021792 | A1 | 1/2013 | Snell et al. | |
| 2013/0335962 | A1 | 12/2013 | Wu et al. | |

OTHER PUBLICATIONS

U.S. Appl. No. 13/800,253, filed Mar. 2013, Holland et al.

* cited by examiner

LOW PROFILE LIGHT HAVING CONCAVE REFLECTOR AND ASSOCIATED METHODS

RELATED APPLICATIONS

This application is a continuation-in-part of U.S. patent application Ser. No. 13/476,388 titled Low Profile Light and Accessory Kit For The Same filed on May 21, 2012, which is in turn a continuation-in-part of U.S. patent application Ser. No. 12/775,310, now U.S. Pat. No. 8,201,968, titled Low Profile Light filed on May 6, 2010, which claims the benefit of U.S. Provisional Patent Application Ser. No. 61/248,665 filed Oct. 5, 2009, the entire contents of each of which are incorporated herein by reference.

FIELD OF THE INVENTION

The present invention relates to luminaires that reflect light emitted by light-emitting elements and, more specifically, to low profile luminaires, and associated methods.

BACKGROUND OF THE INVENTION

This background information is provided to reveal information believed by the applicant to be of possible relevance to the present invention. No admission is necessarily intended, nor should be construed, that any of the preceding information constitutes prior art against the present invention.

Light fixtures come in many shapes and sizes, with some being configured for new work installations while others are configured for old work installations. New work installations are not limited to as many constraints as old work installations, which must take into account the type of electrical fixture/enclosure or junction box existing behind a ceiling or wall panel material. With recessed ceiling lighting, sheet metal can-type light fixtures are typically used, while surface-mounted ceiling and wall lighting typically use metal or plastic junction boxes of a variety of sizes and depths. With the advent of light emitting diode (LED) lighting, there is a great need to not only provide new work LED light fixtures, but to also provide LED light fixtures that are suitable for old work applications, thereby enabling retrofit installations. One way of providing old work LED lighting is to configure an LED luminaire in such a manner as to utilize the volume of space available within an existing fixture (can-type fixture or junction box). However, such configurations typically result in unique designs for each type and size of fixture. Accordingly, there is a need in the art for an LED lighting apparatus that overcomes these drawbacks.

Additionally, the combination of light sources and reflective surfaces, specifically concave or generally domed-shape surfaces, is known. One of the most well-known employments of such a system is in car headlights, wherein a light source, typically a halogen lamp, is operated to emit light that is then reflected by a domed-shaped reflector. However, such a system has not been used in a retrofit-type system as described above. Additionally, where the light source emits light at an intensity that is uncomfortable or potentially harmful for an observer to perceive directly, a diffusing optic has been used to reduce the perceived intensity of the light as well as to achieve a more uniform distribution of light from the system. Diffusing optics have an attending reduction in efficiency that is undesirable. Accordingly, there is a need in the art of a luminaire that overcomes these drawbacks.

SUMMARY OF THE INVENTION

With the foregoing in mind, embodiments of the present invention are related to a luminaire to be carried by a lighting fixture. The luminaire may include a housing, a primary optic disposed within the housing, a light source, and a heat sink. The primary optic may include a reflective inner surface and have a generally concave shape defining an optical chamber. The light source may be positioned in thermal communication with the heat sink and such that light emitted by the light source enters the optical chamber and is incident upon the reflective inner surface. Additionally, the primary optic may have a geometric configuration to reflect light incident thereupon through an aperture of the heat sink. The light source may include a plurality of light-emitting elements, such as a plurality of LEDs.

The light source may be positioned such that none of the LEDs, nor light emitted thereby, is visible from any point external the luminaire. The LEDs may be distributed about a LED board in a desirous fashion that may affect the distribution of light produced by the luminaire, and LEDs that emit different colored lights may be included. The LEDs may be selectively operated so as to cause light to be emitted about the luminaire in optionally even or uneven distributions. The luminaire may further include a secondary optic positioned adjacent to the light source. The secondary optic may collimate and/or refract light emitted by the light source, and may form a seal between the light source and the optical chamber.

DETAILED DESCRIPTION OF THE INVENTION

Figure 1:
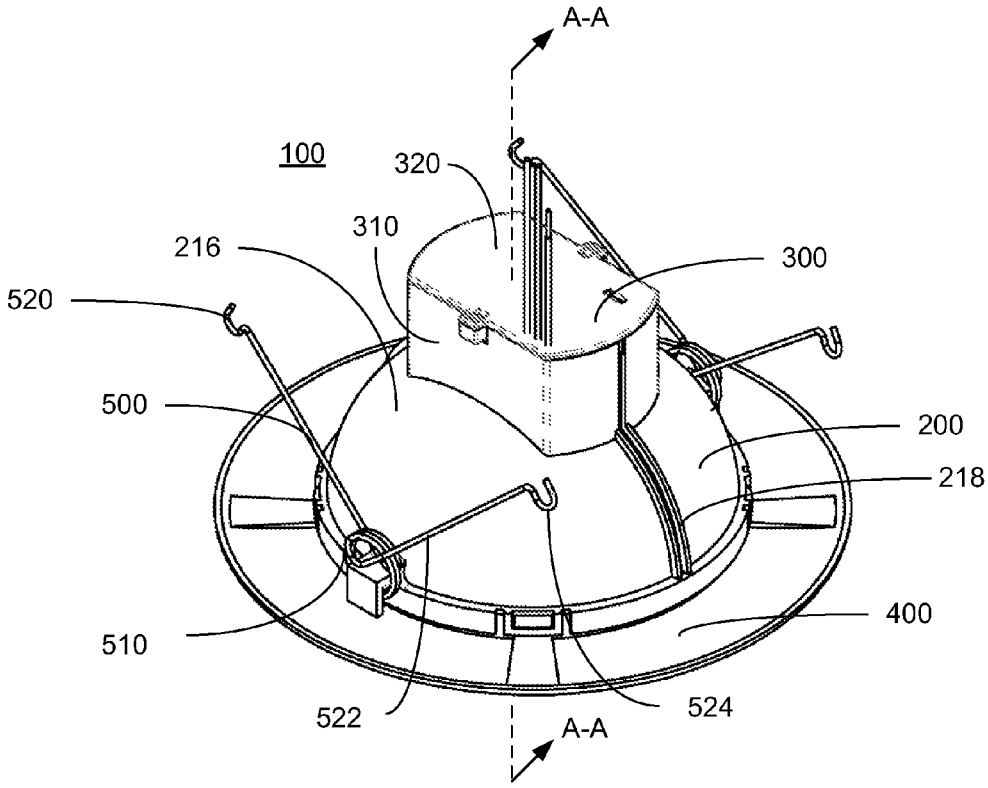
FIG. 1 is a perspective view of a luminaire according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

An embodiment of the invention, as shown and described by the various figures and accompanying text, provides a luminaire configured to be carried by a light fixture. More specifically, referring now to FIG. 1, a luminaire 100 is provided. The luminaire 100 may include a housing 200, an electronics housing member 300 of the housing 200, a heat sink 400, and an attaching member 500. Additionally, now referring to FIG. 1A, the luminaire 100 may further include a light source 600 and a secondary optic 700. The luminaire 100 and its constituent components may be configured to permit the luminaire 100 to be positioned at least partially within and attached to a light fixture such that the luminaire 100 may be carried by the light fixture. In the present embodiment, the luminaire 100 may be configured to be positioned partially within and attached to a canister lighting fixture.

Continuing to refer to FIG. 2, the housing 200 of the present embodiment will now be discussed in greater detail. The housing 200 may be configured to define an interior volume. The housing may include a primary optic 202 positioned within the interior volume of the housing 200. More specifically, the primary optic 202 may be positioned within the interior volume of the housing 200 so as to interface with an inner surface 204 of the housing 200.

The primary optic 202 may include a reflective inner surface 206. The reflective inner surface 206 may be configured to reflect light incident thereupon. More specifically, the reflective inner surface 206 may be configured to reflect at light incident thereupon such that the reflected light has an intensity of at least 95% of the intensity of the light before being reflected.

The reflective inner surface 206 may be configured to be reflective by any method known in the art. For example, and not by way of limitation, the primary optic 202 may be formed of a material that is inherently reflective of light, and therefore the inner surface would inherently be reflective. As another example, the primary optic 202 may be formed of a material that may be polished to become reflective. As yet another example, the primary optic 202, or at least an inner surface of the primary optic 202, may be formed of a material that is permissive of a material being coated, attached, or otherwise disposed thereupon, the disposed material being reflecting. These methods of forming the reflective inner surface 206 are exemplary only and do not serve to limit the scope of the invention. All methods known in the art of forming a reflective surface are contemplated and included within the scope of the invention.

The reflective inner surface 206 may have an efficiency associated with it. More specifically, the reflective inner surface 206 may reflect light incident thereupon at a percentage of the intensity of the incident light. For example the reflective inner surface 206 may reflect incident light at about at least 95% of the original intensity. The reflective inner surface 206 may be configured to reflect incident light at an intensity within the range from about 80% to about 99% of the original intensity.

Additionally, the reflective inner surface 206 may include a color conversion layer. The color conversion layer may be configured to receive a source light having a first wavelength, and convert the wavelength of source light to a second wavelength, defined as a converted light. More details regarding the enablement and use of a color conversion layer may be found in U.S. patent application Ser. No. 13/073,805, entitled MEMS Wavelength Converting Lighting Device and Associated Methods, filed Mar. 28, 2011, as well as U.S. patent application Ser. No. 13/234,604, entitled Remote Light Wavelength Conversion Device and Associated Methods, filed Sep. 16, 2011, U.S. patent application Ser. No. 13/234,371, entitled Color Conversion Occlusion and Associated Methods, filed Sep. 16, 2011, and U.S. patent application Ser. No. 13/357,283, entitled Dual Characteristic Color Conversion Enclosure and Associated Methods, the entire contents of each of which are incorporated herein by reference.

Additionally, the reflective inner surface 206 may include two or more color conversion layers, wherein each color conversion layer is positioned upon different sections of the reflective inner surface 206. Each of the two or more color conversion layers may convert respective source lights of differing wavelengths to respective converted lights of differing wavelengths. The reflective inner surface 206 may include any number of color conversion layers in any configuration, including overlapping layers.

The primary optic 202 may be configured into any shape. As depicted in FIG. 2, the primary optic 202 may be configured into a generally concave shape. More specifically, the primary optic 202 may be configured into a generally domed shape. Further, the primary optic 202 may be configured into a generally speroidal shape. In the present embodiment, the primary optic 202 may be configured into a generally oblate spheroid shape. Many other shapes of the primary optic 202 are contemplated and included within the scope of the invention, including, without limitation, spherical, conical, cylindrical, parabolic, pyramidal, and any other geometric configuration that may reflect light.

The primary optic 202 may at least partially define an optical chamber 208. In the present embodiment, the primary optic 202 defines the upper portion of the optical chamber 208 that is generally hemispheroidal. Light that traverses the optical chamber 208 and is incident upon the reflective inner surface 206 may be reflected back into the optical chamber 208 by the reflective inner surface 206. The optical chamber 208 may be configured so as to permit light that propagates through the optical chamber 208 to combine, forming a combined light. The combined light may be a polychromatic light, having multiple constituent wavelengths of light. In some embodiments, the combined light may be a white light. Additional information regarding color combination may be found in U.S. patent application Ser. No. 13/107,928, entitled High Efficacy Lighting Signal Converter and Associated Methods, filed May 15, 2011, as well as U.S. Patent Application Ser. No. 61/643,308, entitled Tunable Light System and Associated Methods, filed May 6, 2012, the entire contents of each of which are incorporated by reference herein.

The primary optic 202 may be configured to have an open end. The open end may be configured to be permit light traversing the optical chamber 208 to pass therethrough. Furthermore, the open end may cooperate with additional structures of the luminaire 100 to permit the traversal of light from the optical chamber 208 to the environment.

The primary optic 202 may be configured into a geometric shape so as to control the direction of light reflected from the reflective inner surface 206. For example, the primary optic 202 may be configured to reflect light incident thereupon such that the light is reflected to propagate through the open end of the primary optic 202.

Figure 2:
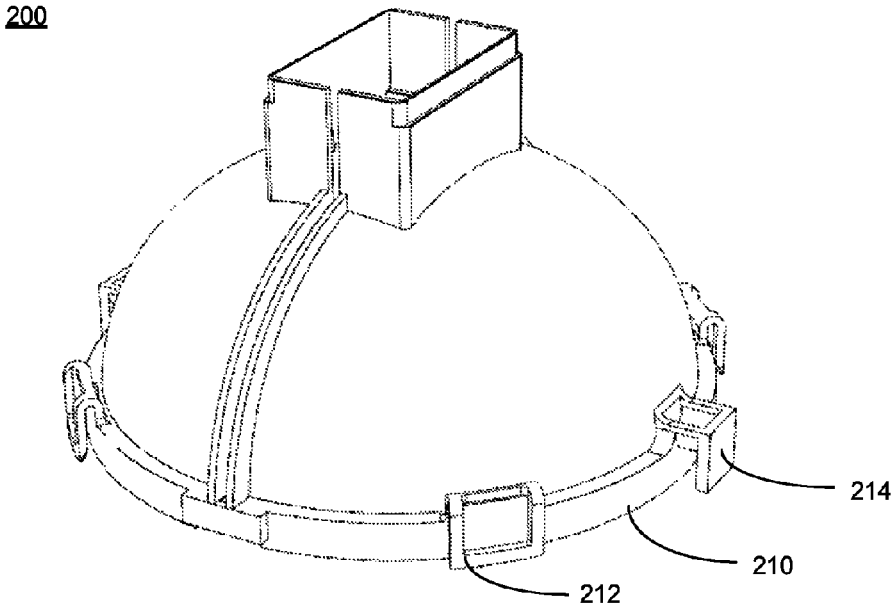
FIG. 2 is a perspective view of a housing of the luminaire depicted in FIG. 1.

Referring now to FIG. 2, the housing 200 will now be discussed in greater detail. The housing 200 may include an attachment section 210. The attachment section 210 may configured to be at a lower end of the housing 200. The attachment section 210 may include heat sink attachment structures 212 and attaching member attachment structures 214. Additionally, the housing 200 may further include a channel 218 formed on an outer surface 216 of the housing 200. The channel 218 may be formed so as to facilitate the disposal of an electrical connector, such as one or more wires, within the channel 218, thus enabling establishing an electrical connection between electronic components within the electronics housing member 300 and electrical devices of the luminaire 100, such as the light source 600.

The heat sink attachment structures 212 may be distributed in a spaced configuration about the attachment section 210. The heat sink attachment structures 212 may be configured to engage with a cooperating structure on the heat sink 400 so as to removably attach the heat sink 400 to the housing 200. As shown in the present embodiment, the heat sink attachment structures 212 may be configured as slots into which clips may be disposed. This embodiment is exemplary only and all methods of removable attachment are contemplated and included within the scope of the invention.

Similarly, the attaching member attachment structures 214 may be distributed in a spaced configuration about the attachment section 210 and may be configured to engage with the attaching member 500. In the present embodiment, the attaching member attachment structures 214 are configured as L-shaped structures permitting a portion of the attaching member 500 to be disposed in a region between the attaching member attachment structures 214 and the housing 200. This embodiment is exemplary only and all methods of removable attachment are contemplated and included within the scope of the invention.

Figure 3:
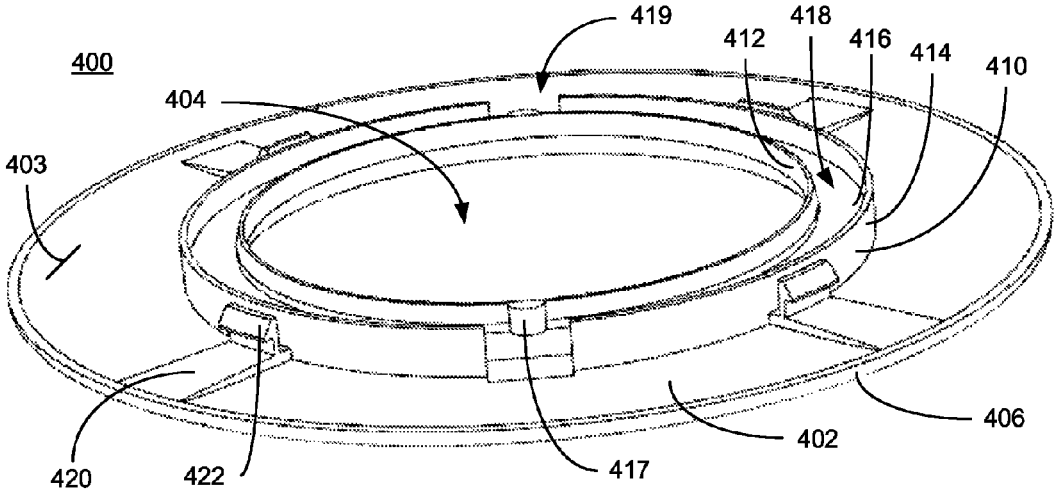
FIG. 3 is a perspective view of a heat sink of the luminaire depicted in FIG. 1.

Referring now to FIG. 3, the heat sink 400 will now be discussed in greater detail. The heat sink 400 may be configured thermally coupled to elements of the luminaire 100 so as to increase the thermal dissipation capacity of the luminaire 100. The heat sink 400 may include a body member 402, a support structure 410, and housing attachment structures 420. As shown in FIG. 1A, the body member 402 may be configured to cooperate with the primary optic 202 to completely define the optical chamber 208. More specifically, the body member 402 may define the lower boundary of the optical chamber 208.

Referring now back to FIG. 3, the body member 402 may be configured to define an aperture 404. The aperture 404 may be a void formed by the body member 402 somewhere within a periphery 406 of the body member 404. In the present embodiment, the aperture 404 is formed approximately at the center of the body member 402. Furthermore, the aperture 404 may be configured into any geometric configuration. In the present embodiment, the aperture 404 is generally elliptical. More specifically, the aperture 404 is formed into a generally circular configuration. This embodiment is exemplary only, and the aperture 404 may be formed into any other geometric configuration, including, without limitations, ovals, semicircles, triangles, rectangles, and any other polygon.

The aperture 404 may be configured so as to cooperate with the open end of the primary optic 202 to permit light traversing through the open end to similarly traverse the aperture 404 and propagate into the environment surrounding the luminaire 100, more specifically, the environment immediately surrounding the heat sink 400.

The body member 402 may be formed into any geometric configuration. In the present embodiment, the body member 402 is formed into a generally elliptical configuration. More specifically, the body member 402 is formed into a circular configuration. Additionally, due to the positioning of the aperture 404 at the center of the body member 402 and the aperture 404 being configured as a circle, the body member 402 may be described as annular. This embodiment is exemplary only, and the body member 402 may be formed into any other geometric configuration, including, without limitations, ovals, semicircles, triangles, rectangles, and any other polygon, with the aperture 404 being formed somewhere within the periphery 406 of these geometric configurations. Moreover, the body member 402 and the aperture 404 may be selectively formed into identical, similar, or entirely different geometric configurations. In forming each of the body member 402 and the aperture 404, the geometric configuration of a light fixture in which the luminaire 100 may be disposed may be considered.

The body member 402, as well as the other various elements of the heat sink 400 may be formed of a thermally conductive material. Forming the body member 402 of thermally conductive material may increase the thermal dissipation capacity of the heat sink 400 as well as the luminaire 100 generally. Examples of thermally conductive materials include metals, metal alloys, ceramics, and thermally conductive polymers, such as CoolPoly® and Therma-Tech™. This list is not exhaustive, and all other thermally conductive materials are contemplated and within the scope of the invention.

The support structure 410 will now be discussed in greater detail. The support structure 410 may be configured to attach, carry, or otherwise become engaged with various elements of the luminaire 100, including the light source 600 and the secondary optic 700, as shown in FIG. 1A. Referring now to FIG. 3, the support structure 410 is shown in greater detail. The support structure 410 may be positioned on a surface of the body member 402. More specifically, the support structure 410 may be positioned on an interior surface 403 of the body member 402.

Additionally, the support structure 410 may be positioned in a relationship to the aperture 404. In the present embodiment, the support structure 410 is positioned generally about the aperture 404. More specifically, the support structure 410 may be positioned about the periphery of the aperture 404, generally circumscribing the aperture 404.

Furthermore, the support structure 410 may be positioned so as to result in desirable emission characteristics of the light source 600 where the light source 600 is engaged with the support structure 410. Accordingly, the positioning of the support structure 410 may be done so in light of emission characteristics of the light source 600 as well as reflective characteristics of the primary optic 202.

Additionally, the support structure 410 may be formed into a geometric configuration. In the present embodiment, the support structure 410 is formed into a generally annular configuration. This configuration is exemplary only, and the support structure 410 may be formed into any geometric formation. Moreover, the support structure 410 may be formed into a geometric configuration identical, similar, or different from the geometric configurations of the aperture 404 and/or the body member 402. Additionally, the support structure 410 may be formed into a geometric configuration so as to facilitate engagement with either of the light source 600 or the secondary optic 700, or both.

Continuing to refer to FIG. 3, the support structure 410 may include an anterior wall 412, a posterior wall 414, and a base 416. The anterior wall 412, base 416, and posterior wall 414 may cooperate so as to define a trough 418 therebetween. Additionally, the anterior wall 412 may cooperate in defining the aperture 404. The trough 418 may be configured and dimensioned so as to permit the light source 600 to be disposed therewithin. Additionally, the anterior wall 412 and the posterior wall 414 may be configured so as to permit the secondary optic 700 to be attached thereto. Furthermore, the respective heights of each of the anterior wall 412 and the posterior wall 414 may be configured so as to accommodate a desirable angle of inclination of the secondary optic 700 when the secondary optic 700 is attached thereto. In the present embodiment, the posterior wall 414 may have a height that is greater than the height of the anterior wall 412. Other configurations of the respective and relative heights of the anterior and posterior walls 412, 414 are contemplated and included within the scope of the invention.

As the support structure 410 is part of the heat sink 400, it may be formed of any thermally conductive material describe hereinabove. Moreover, the support structure 410 may be configured to maximize its thermal dissipation capacity. More specifically, the support structure 410 may be configured to maximize the conduction of heat to the body member 402 from any heat-generating element positioned in thermal communication with the support structure 410, such as, for instance, the light source 600. Accordingly, the support structure 410 may be configured to maximize the surface area of the interface between the elements of the support structure 410 and the light source 600, providing that such interfacing does not impede the propagation of light emitted by the light source 600.

Additionally, the support structure 410 may include one or more outcroppings 417. The outcroppings 417 may be positioned to extend from the anterior wall 412 into the trough 418. The outcroppings 417 may be configured to interface with the light source 600 when the light source 600 is disposed within the trough 418 so as to desirously position the light source 600 within the trough 418 and/or reduce movement of the light source 600 within the trough 418.

The support structure 410 may include one or more ports 419. The ports may be configured to permit the positioning of an element of the luminaire 100 to traverse between an area generally above the interior surface 403 of the body member 402 and the trough 418. Accordingly, the ports 419 may be positioned in the posterior wall 414 of the support structure 410. In the present embodiment, the ports 419 are positioned generally opposite the outcroppings 417.

Figure 1A:
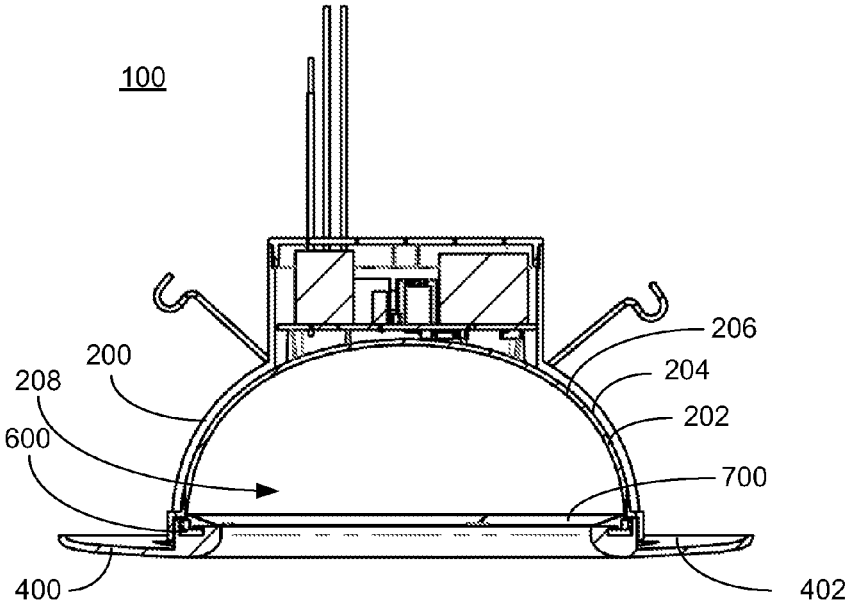
FIG. 1A is a cross-sectional view of the luminaire depicted in FIG. 1 taken through line A-A.

The heat sink 400 may be configured to be removably attached to the housing 100, as shown in FIG. 1. More specifically, the housing attachment structures 420 may be configured to engage with the heat sink attachment structures 212 of the housing 200 so as to removably attach the heat sink 400 to the housing 200. The housing attachment structures 420 may be positioned on the interior surface 403 of the body member 402. In the present embodiment, the housing attachment structures 420 may be clips 422 configured to engage with the slots of the present embodiment of the heat sink attachment structures 212, thereby removably attaching the heat sink 400 to the housing 200. More specifically, the clips 422 may be flexible so as to deflect, permitting the clips 422 to pass by and become disposed within the slots. This may be accomplished by translating the heat sink 400 generally vertically towards the housing 200. Moreover, the heat sink 400 may be detached from the housing 200 by imparting a force onto the heat sink 400 causing the clips 422 to deflect, thereby removing the clips from within the slots and permitting the heat sink 400 to be translated vertically away from the housing 200, thereby detaching the heat sink 400 from the housing 200. This embodiment is exemplary only and all methods and structures of removable attachment are contemplated and included within the scope of the invention.

Figure 4:
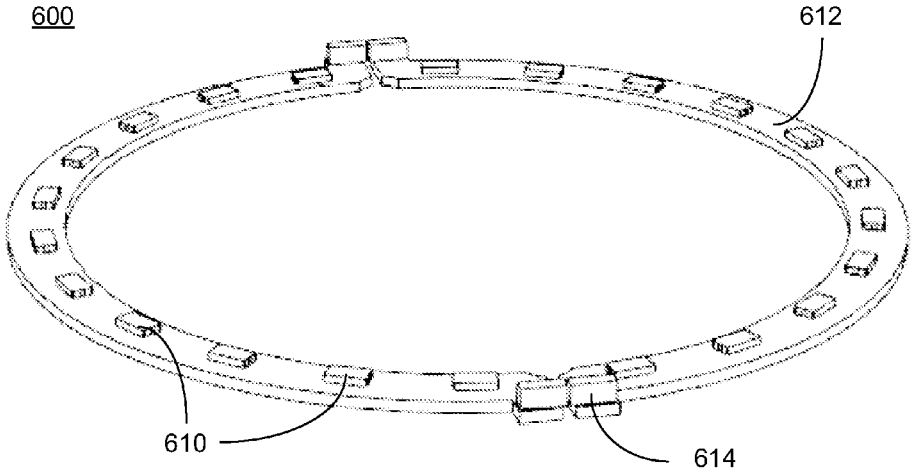
FIG. 4 is a perspective view of a light source of the luminaire depicted in FIG. 1.

The light source 600 will now be discussed in greater detail. As shown in FIGS. 1A 3, and 4, the light source 600 may be configured to be disposed within the trough 418. Accordingly, the light source 600 may be configured to conform to a geometric configuration. In the present embodiment, the light source 600 is configured into a generally annular geometric configuration. This configuration is exemplary only, and the light source 600 may be formed into any geometric configuration. Where the light source 600 is positioned within the trough 418, it may be configured into a geometric configuration permitting its disposal therewithin.

Additionally, the light source 600 may be desirously positioned within the luminaire 100. For example, the light source 600 may be positioned within the luminaire 100 such that light that propagates into the environment surrounding the luminaire 100 is generally controlled. As a further example, the light source 600 may be positioned such that the light source 600 is not visible from any point in the environment external the luminaire 100. Similarly, the light source 600 may be positioned such that light emitted from the light source 600 is not directly observable from any point in the environment external the luminaire 100. Instead, any light that is visible from a point in the environment external the luminaire 100 will be reflected, such as light that is reflected from the reflective inner surface 206.

While the current embodiment has specific structural features, such as a generally annular heat sink 400 having an aperture 404, it is contemplated and within the scope of the invention that this method of indirect lighting, where all light perceived by an observer in the environment external the luminaire 100 has been reflected at least once and there is no light emitted from the light source 600 that is directly visible by such an observer may be applied to luminaires 100 having different structural features, such as those conforming to form factors including, but not limited to, A19, G25, BR 20, and any other standard for light bulb form known in the industry. Moreover, the use of an optical chamber, such as the optical chamber 208 of the present embodiment, may similarly be included in the alternative form factors, as well as a light source 600 and color conversion layer so as to achieve desirable characteristics of light emitted by the luminaire.

The positioning of the light source 600, and the light-emitting elements 610, may take into account the direction that light emitted therefrom will propagate, as well as any other element or structure of the luminaire 100 with which it may be incident upon and interact with. Specifically, the light source 600 and plurality of light-emitting elements 610 may be positioned taking into account the incidence of emitted light upon the reflective inner surface 208 and the reflection of the light therefrom. Furthermore, due to the shape of the reflective inner surface 208, the incidence of light emitted from individual light-emitting elements 610 from a certain position may result in light being reflected from the reflective inner surface 208 and propagating therefrom in a predictive direction. As described hereinabove, light reflected from the reflective inner surface 208 may propagate into the environment surrounding the luminaire 100 through the aperture 404 of the heat sink 40.

Accordingly, the light-emitting elements 610 may be positioned such that light emitted from each of the plurality of light-emitting elements may propagate through the aperture 404 and into the environment surrounding the luminaire 100 in a predictive direction. For example, the light emitted from a light-emitting element may be reflected by the reflective inner surface 208 and propagate through the aperture in a direction that is generally radially opposite the radial direction of the light-emitting element 610 relative to a longitudinal axis of the luminaire 100. Additionally, where the plurality of light-emitting elements 610 are positioned in a distributed configuration, as depicted in FIG. 4, each of the light-emitting elements 610 may be selectively operated to redirect the balance of light produced from luminaire 100.

For example, where all of the plurality of light-emitting elements 610 are operated, the light produced by the luminaire 100 may be generally equally distributed about the environment external the luminaire 100, specifically the environment generally defined as a hemisphere beneath the heat sink 400. Where only subsets or individual light-emitting elements 610 are selectively operated, the light produced by the luminaire 100 may be unevenly distributed about the environment external the luminaire 100, such as being distributed more to one side than another, or to form a staggered pattern of lighting. All distributions of light produced by the luminaire 100 into the environment surrounding the luminaire 100 are contemplated and included within the scope of the invention.

Referring now to FIG. 4, aspects of the light source 600 will now be discussed in greater detail. The light source 600 may include one or more light-emitting elements 610. Wherein there are two or more light-emitting elements 610, it will be referred to as a plurality of light emitting elements 610. The light-emitting elements 610 may be operable to emit light. The light-emitting elements 610 may be configured to emit light in a direction so as to propagate into the optical chamber 208.

Additionally, each of the light-emitting elements 610 may emit light within a wavelength range. More specifically, each of the light-emitting elements may emit light having a wavelength range within the wavelength range from about 390 nanometers to about 750 nanometers, commonly referred to as the visible spectrum. Each of the light-emitting elements 610 may emit light having a wavelength range identical or similar to the wavelength range to another of the light-emitting elements 610, or it may emit light having a wavelength range different from another of the light-emitting elements 610.

The selection of light-emitting elements 610 included in the light source 600 may be made so as to produce a desirous combined light, as described hereinabove. Accordingly, the light source 600 may include light-emitting elements 610 that produce light having a variety of wavelengths such that the emitted light combines in the optical chamber 208 to form a combined polychromatic light. In some embodiments, the combined light may be observed by an observer in the environment external the luminaire 100 as a generally white light. Moreover, the combined light may have desirous characteristics, such as certain color temperatures and color rendering indices. The methods of forming such a combined light are discussed in the references incorporated by reference hereinabove. For example, the light source 600 may include light-emitting elements 610 that emit light that combines to produce a combined light that is generally white in color or any other color such as those represented on the 1931 CIE color space, having a color temperature within the range from about 2,000 Kelvin to about 25,000 Kelvin, and/or having a coloring rendering index within the range from about 15 to about 100. Moreover, in addition to including light-emitting elements 610 to produce a combined light having desirous characteristics, the luminaire 100 may include one or more color conversion layers configured to convert light from a first source wavelength to a second converted wavelength as described in greater detail hereinabove and hereinbelow.

The light-emitting elements 610 may be any device capable of or method of emitting light. Such devices and methods include, without limitation, incandescent light bulbs, fluorescent lights, light-emitting semiconductors, arc lamps, and any other devices and methods known in the art. In the present embodiment, the light-emitting elements 610 are light-emitting semiconductors, more specifically, light-emitting diodes (LEDs). Additionally, as in the present embodiment, where the light-emitting elements 610 are LEDs, the light source 600 may further include an LED board 612. The LED board 612 may include necessary circuitry so as to enable the operation of the LEDs. Furthermore, the LED board 612 may include the necessary circuitry so as to enable individual operation of each of the LEDs. Other embodiments of the light source 600 may include light-emitting elements 610 other than LEDs, but may include a structure similar to the LED board 612 that enables the operation of the light-emitting elements 610.

In the present embodiment, the LED board 612 may generally define the shape of the light source 600. Accordingly, the LED board 612 may be configured to have a geometric configuration substantially as described for the light source 600 described hereinabove.

In the present embodiment, the LEDs 610 are disposed on and operably coupled to the LED board 612. The LEDs 610 may be distributed about the LED board 612 in any desirable pattern, configuration, or arrangement. For example, where the LED board 612 may be divided into two sides, one side of the LED board 612 may have disposed thereon more LEDs 610 than on the other side. As another example, the LEDs 610 may be distributed about the LED board 612 substantially evenly. It is contemplated by the invention that the distribution of LEDs 610 on the LED board 612, and the distribution of light-emitting elements generally, may affect the propagation of light into the optical chamber, the intensity of light incident upon various sections of the primary optic 202, and the light emission characteristics of the luminaire 100. Additionally, wherein the LEDs 610 include LEDs that emit light within different wavelength ranges, the distribution of the LEDs 610 with differing wavelength ranges may similarly affect the light emission characteristics of the luminaire 100.

The LED board 612 may further include electrical contacts 614. The electrical contacts 614 may be electrically connected to each of the LEDs 610, thereby enabling the operation of the LEDs 610. Additionally, the electrical contacts 614 may be configured to interface with and electrically couple to an electrical connector that can supply electrical power to the electrical contacts 614, thereby enabling the operation of the LEDs 610. Additionally, the electrical contacts 614 may be configured to enable the selective operation of each LED 610 of the LEDs 610 by permitting operating signals to be transmitted therethrough.

In some embodiments, the LED board 612 may include a reflective surface. The reflective surface may be on a surface to which the LEDs 610 are attached or adjacent to, in any case the surface of the LED board 612 upon which light emitted by the LEDs 610 is incident upon. The reflective surface of the LED board 612 may reflect light incident thereupon back into the optical chamber 208, thereby reducing the loss of light that would not otherwise be reflected by the LED board 612.

Figure 5:
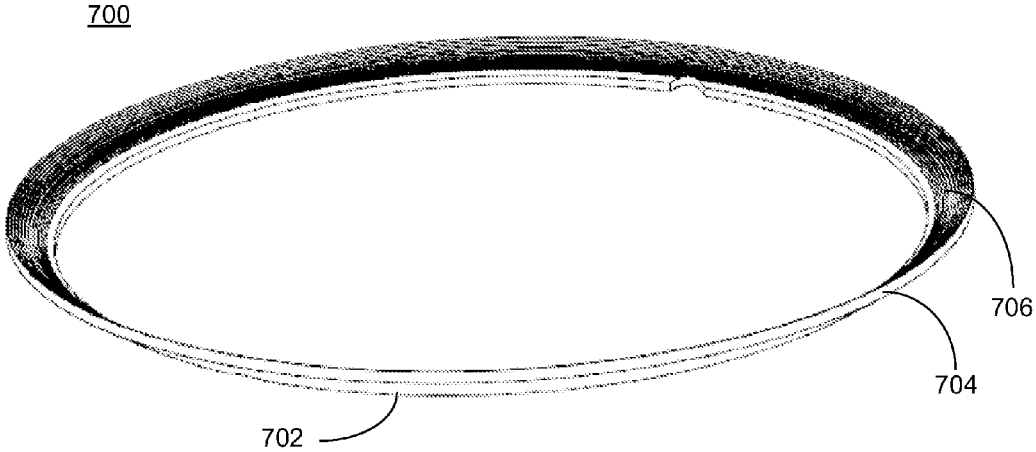
FIG. 5 is a perspective view of a secondary optic of the luminaire depicted in FIG. 1.

As shown in FIG. 1A, the secondary optic 700 of the present embodiment will now be discussed in greater detail. Referring now to FIG. 5, the secondary optic 700 may be configured to be disposed in relation to the light source 600 such that light emitted from the light-emitting elements 610 is incident upon the secondary optic 700. Accordingly, the secondary optic 700 may be formed into a geometric configuration that is generally similar to the geometric configuration of the light source 600. In the present embodiment, the secondary optic 700 is formed into an annular geometric configuration. This configuration is exemplary only, and the secondary optic 700 may be formed into any geometric configuration.

Additionally, the secondary optic 700 may be configured to shield the light source 600 from the environment of the optical chamber 208, which may be in communication with the environment external the luminaire 100. As shown in FIG. 1A, the secondary optic 700 may interface a structure of the heat sink 400 so as to form a seal therebetween, shielding the light source 600 from the environment of the optical chamber 208. More specifically, as described hereinabove, the secondary optic 700 may include an anterior edge 702 and a posterior edge 704. The anterior edge 702 may be configured to interface with and attach the anterior wall 412 of the heat sink 400, and the posterior edge 704 may be configured to interface with and attach to the posterior wall 414 of the heat sink 400, thereby forming the aforementioned seal. Additionally, the secondary optic 700 may be carried by the heat sink 400 by the attachment between the anterior and posterior edges 702, 704, to the anterior and posterior walls 412, 414, respectively.

The secondary optic 700 may be configured to refract light incident upon it. As in the present embodiment, the secondary optic 700 may include an outer surface 706 having plurality of approximately orthogonal sections formed therein. The orthogonal sections may be configured to desirously refract light incident thereupon. More specifically, the orthogonal sections may be configured to collimate light incident thereupon, such as light emitted by the light source 600. The structure and use of a refracting optic is described in U.S. Patent Application Ser. No. 61/642,205, entitled Luminaire with Prismatic Optic, filed May 3, 2012, which is incorporated herein by reference. Moreover, the secondary optic 700 may be formed so as to refract light incident thereupon from one of the plurality light-emitting elements 610 so as to refract the incident light in a desirous direction. Further, the direction of the refraction may be configured to cause the refracted light to propagate through the optical chamber 208 such that the refracted light is incident upon a desirous section of the reflecting inner surface 206. Yet further, the direction of the refraction may result in the propagation of the refracted-reflected light into the environment surrounding the luminaire 100 in a desirous direction.

In some embodiments, the secondary optic 700 may include a color conversion layer. The color conversion layer of the secondary optic 700 may be configured similarly to the color conversion layer as described for the reflective inner surface 206 of the primary optic 202.

Referring now back to FIG. 1, the electronics housing member 300 will now be discussed in greater detail. The electronics housing member 300 may be positioned on the outer surface 216 of the housing 200, the outer surface 216 being generally opposite the reflective inner surface 206. The electronics housing member 300 may be configured to permit electronic components necessary to enable the operation of the luminaire disposed therein. The electronics housing member 300 may include a walled portion 310 that is attached at a first end to the outer surface 216 of the housing 200, and a cap 320 that is configured to attach to a second end of the walled portion 310. The walled portion 310 and the cap 320 may cooperate so as to define an internal volume of the electronics housing member 300 wherein the electronic components may be positioned. The cap 320 may further include one or more apertures to enable the wired connection of electronic components disposed within the electronics housing member 300 with devices external the luminaire 100. The walled portion 310 may be formed as a separate structure from the housing 200, or it may be formed as an integral member of the housing 200.

Figure 6:
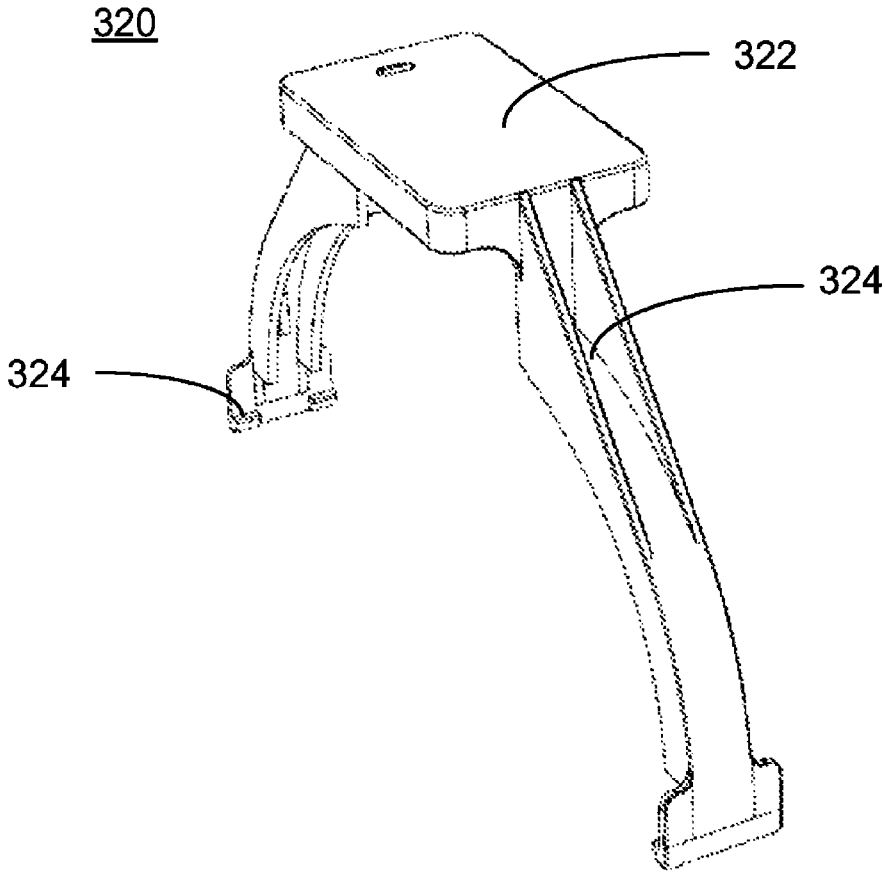
FIG. 6 is a perspective view of an embodiment of a cap of an electronics housing member of the luminaire depicted in FIG. 1.

Furthermore, in some embodiments, such as the embodiment depicted in FIG. 6, the cap 320 may include a body member 322 and a pair of arms 324 extending from the body member 322. The arms 324 may be configured to be disposed adjacent to and interfacing with the channels 218 so as to generally shield any electrical connectors positioned within the channel 218. Furthermore, the arms 324 may further include attachment clips 326 at an end of the arm 324 generally opposite the end where the arm 324 attaches to the body member 322. The attachment clips 326 may be configured to cooperate with a structure of the housing 200 so as to removably attach the cap 320 to the housing 200 in a position so as to generally cover an open end of the walled portion 310.

A variety of electronic devices may be disposed within the electronics housing member 300. One such device may be a power conditioning unit. The power conditioning unit may be able to receive electrical power from an external power supply and condition the electrical power into a voltage that is usable by the light source 600, other electrical components associated with the luminaire 100, or both. Accordingly, the power conditioning unit may be positioned in electrical communication with any electronic component of the luminaire 100, including the light source 600. The light source 600, and the other various electronic and electrical components of the luminaire 100, may be energized and rendered operable by electrical power supplied by the power conditioning unit. For example, the power conditioning unit may receive an AC voltage and produce a DC voltage at a desired voltage. As another example, the power conditioning unit may receive a DC voltage at a first voltage and produce a DC voltage at a second voltage. Additionally, the power conditioning unit may be configured to receive a variety of voltages and produce a variety of voltages. This and all other variations of power conditioning known in the art are contemplated and included within the scope of the invention. As a specific example, and not serving to limit the scope of the invention, the power conditioning unit may be configured to comply with power-over-Ethernet standards.

Another example of an electronic component that may be positioned within the electronics housing member 300 may be a controller. The controller may be positioned so as to be electrical communication with a power conditioning unit so as to be rendered operational. Additionally, the controller may be operably connected to the light source 600 so as to control the operation of the light source 600. The controller may be configured to operate the light source 600 between operating and non-operating states, wherein the light source 600 emits light when operating, and does not emit light when not operating. Furthermore, where the light source 600 includes a plurality of light-emitting elements 610, the controller may be operably connected to the plurality of light emitting elements 610. Yet further, the controller may be operably connected to the plurality of light-emitting elements 610 so as to selectively operate each of the plurality of light-emitting elements 610. Accordingly, the controller may be configured to operate the light-emitting elements 610 as described hereinabove. Moreover, the controller may be configured to operate the light-emitting elements 610 so as to control the color, color temperature, and distribution of light produced by the luminaire 100 into the environment surrounding the luminaire 100 as described hereinabove.

In addition to selective operation of each of the plurality of light-emitting elements 610, the controller may be configured to operate each of the plurality of light-emitting elements 610 so as to cause each light-emitting element 610 to emit light either at a full intensity or a fraction thereof. Many methods of dimming, or reducing the intensity of light emitted by a light-emitting element, are known in the art. Where the light-emitting elements 610 are LEDs, the controller may use any method of dimming known in the art, including, without limitation, pulse-width modulation (PWM) and pulse-duration modulation (PDM). This list is exemplary only and all other methods of dimming a light-emitting element is contemplated and within the scope of the invention. Further disclosure regarding PWM may be found in U.S. patent application Ser. No. 13/073,805, the entire contents of which are incorporated by reference hereinabove.

Referring again to FIG. 1, the attaching member 500 will now be discussed in greater detail. The attaching member 500 may be configured to attach the luminaire 100 to a lighting fixture such that the luminaire 100 may be carried by the lighting fixture. The structure of the attaching member 500 will vary according to the type of lighting fixture to which the luminaire 100 is desirously to be attached to. In the present embodiment, the luminaire 100 is to be attached to a canister lighting fixture. Accordingly, the attaching member 500 may be configured and include structures to facilitate attachment of the luminaire 100 to a canister lighting fixture.

In the present embodiment, the attaching member 500 includes a housing attachment section 510 and a fixture attachment section 520. The housing attachment section 510 may be configured to attach to a structure of the housing 200 so to attach the attaching member 500 to the housing 200. In the present embodiment, the housing attaching section 510 may be configured to attach to the attaching member attachment structures 214 of the housing 200. Moreover, the attachment between the housing attachment section 510 and the housing 200 must be of sufficient strength to support the weight of the luminaire 100 as well as any forces experienced by or exerted upon the luminaire 100, during installation and removal.

In the present embodiment, the housing attaching section 510 may be configured as a coil of wire forming a spring, the spring facilitating the installation of the luminaire 100 as described in greater detail hereinbelow. The housing attaching section 510 of the present embodiment may be disposed within the region between the attaching member attachment structure 214 and the outer surface 216 of the housing 200 and abut the attaching member attachment structure 214 so as to exert a force thereon, establishing the attachment between the attaching member 500 and the housing 200.

The fixture attachment section 520 may be configured to engage with a lighting fixture so as to attach the attaching member 500, and hence the luminaire 100, to the lighting fixture. As stated hereinabove, the present embodiment of the invention is configured to attach to a canister light fixture. In order to accomplish this attachment, the fixture attachment section 520 comprises a pair of tangs 522 extending generally away from the housing attachment section 510 and away from each other. The tangs 522 may be configured to as to extend generally beyond the housing 200. Each of the fixture attachment sections 520 may further include an interfacing section 524 positioned at an end of the tang 522. The interfacing section 524 may be configured to interface with a wall of the canister lighting fixture. When the interfacing section 524 of each of the pair of tangs 522 interfaces with the wall of the canister lighting fixture, the tangs 522 may deflect inward, toward the housing attachment section 510.

Where, as in the present embodiment, the housing attachment section 510 is a spring, it will exert a force on the tangs 522 in a direction generally opposite the direction of deflection of the tangs 522. Accordingly, the interfacing sections 524 will be pressed against the wall of the canister lighting fixture, creating a frictional force therebetween. The housing attachment section 510 may be configured to exert a force upon the tangs 522 such that it creates a frictional force between the interfacing section 524 and the wall of the canister lighting fixture of sufficient strength to removably attach the luminaire 100 to the canister lighting fixture.

In some embodiments, the luminaire 100 may further include a sensor. The sensor may be configured to affect the operation of the light source 600. For example, the sensor may be in electrical communication with a controller as described hereinabove. The sensor may transmit a signal to the controller indicating that the controller should either operate the light source 600 or cease operation of the light source 600. For example, the sensor may be an occupancy sensor that detects the presence of a person within a field of view of the occupancy sensor. When a person is detected, the occupancy sensor may indicate to the controller that the light source 600 should be operated so as to provide lighting for the detected person. Accordingly, the controller may operate the light source 600 so as to provide lighting for the detected person. Furthermore, the occupancy sensor may either indicate that lighting is no longer required when a person is no longer detected, or either of the occupancy sensor or the controller may indicate lighting is no longer required after a period of time transpires during which a person is not detected by the occupancy sensor. Accordingly, in either situation, the controller may cease operation of the light source 600, terminating lighting of the environment surrounding the luminaire 100. The sensor may be any sensor capable of detecting the presence or non-presence of a person in the environment surrounding the luminaire 100, including, without limitation, infrared sensors, motion detectors, and any other sensor of similar function known in the art. More disclosure regarding motion-sensing luminaires and occupancy sensors may be found in U.S. patent application Ser. No. 13/403,531, entitled Configurable Environmental Sensing Luminaire, System and Associated Methods, filed Feb. 23, 2012, and U.S. patent application Ser. No. 13/464,345, entitled Occupancy Sensor and Associated Methods, filed May 4, 2012, the entire contents of both of which are herein incorporated by reference.

Additionally, the luminaire 100 may further include a network interface. The network interface may be configured to establish connection with a network and communicate with other electronic devices similarly connected to the network there across. Furthermore, the network interface may be in communication with the various electronic components and devices of the luminaire 100, thereby enabling the various electronic components and devices of the luminaire 100 to communicate with other electronic devices across the network. For example, the network interface may connect to a network of a plurality of luminaires 100 according to the present invention. Furthermore, the luminaire 100 may be configured to transmit and/or receive signals across the network via the network interface affecting the operation of light source 600. For example, the luminaire 100, or more specifically an electronic device of the luminaire, such as a controller, may be placed in communication with the network interface and receive a signal across the network containing an instruction to either operate or cease operation of the light source 600. The controller may then operate the light source 600 responsive to the received signal. Furthermore, the controller may similarly transmit a signal to other luminaires across the network with a similar instruction to either operate or cease operation of the luminaires' respective light sources. More disclosure regarding networked lighting and attending luminaires may be found in U.S. patent application Ser. No. 13/463,020, entitled Wireless Pairing System and Associated Methods, filed May 3, 2012 and U.S. patent application Ser. No. 13/465,921, entitled Sustainable Outdoor Lighting System and Associated Methods, filed May 7, 2012, the entire contents of both of which are incorporated herein by reference.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A luminaire adapted to be carried by a light fixture comprising:

a housing;

a primary optic disposed within the housing having a reflective inner surface and a generally concave shape defining an optical chamber;

a light source; and a heat sink being generally annular and defining an aperture;

wherein the light source is positioned in thermal communication with the heat sink; and wherein light emitted by the light source enters the optical chamber incident upon the reflective inner surface of the primary optic, and is reflected through the aperture of the heat sink member.

2. A luminaire according to claim 1 wherein the light source comprises a plurality of light-emitting diodes (LEDs) disposed on an LED board.

3. A luminaire according to claim 2 wherein the LED board is generally annular; wherein the plurality of LEDs are distributed about the LED board; and wherein the heat sink comprises a generally annular support structure configured to permit the LED board and the plurality of LEDs to be disposed thereon.

4. A luminaire according to claim 2 wherein the plurality of LEDs comprises a first set of LEDs configured to emit light having a first color and a second set of LEDs configured to emit light having a second color.

5. A luminaire according to claim 2 further comprising a controller operably connected to the plurality of LEDs; wherein the controller is configured to selectively operate each LED of the plurality of LEDs.

6. A luminaire according to claim 5 wherein the light emitted by each of the plurality of LEDs is reflected through the aperture of the heat sink in a radial direction generally opposite the radial direction of the LED relative to a longitudinal axis of the luminaire; and wherein the controller is configured to selectively operate each LED of the plurality of LEDs between operating and non-operating states; wherein light is emitted in the operating state and light is not emitted in the non-operating state, to selectively emit light in selected directions.

7. A luminaire according to claim 5 wherein the controller is configured to control the luminous intensity of light emitted from each LED of the plurality of LEDs by pulse-width modulation.

8. A luminaire according to claim 2 wherein the plurality of LEDs are disposed on a surface of the LED board; wherein the LED board further comprises a reflective layer disposed on the same surface as the plurality of LEDs; wherein the reflective layer is positioned so as not to occlude the plurality of LEDs; and wherein the reflective layer reflects light incident thereupon into the optical chamber.

9. A luminaire according to claim 1 wherein the reflective inner surface reflects light incident thereupon at an intensity of at least about 95% of the original intensity of the incident light.

10. A luminaire according to claim 1 further comprising a secondary optic positioned adjacent to the light source; wherein the secondary optic is configured to attach to the heat sink and form a seal between the light source and the optical chamber.

11. A luminaire according to claim 10 wherein the secondary optic is configured to at least one of collimate and refract light emitted by the light source.

12. A luminaire according to claim 10 wherein at least one of the primary optic and the secondary optic comprises a color conversion layer; wherein the light source is configured to emit a source light within a first wavelength range; wherein the color conversion layer converts the source light to a converted light within a second wavelength range; and wherein the color conversion layer comprises a conversion material selected from the group consisting of phosphors, quantum dots, luminescent materials, and fluorescent materials.

13. A luminaire according to claim 1 further comprising a power conditioning unit; wherein the power conditioning unit is configured to comply with power-over-Ethernet standards.

14. A luminaire according to claim 1 further comprising an attaching member;

wherein the primary optic further comprises an attaching member attachment structure positioned on the outer surface of the primary optic;

wherein the attaching member comprises a housing attachment section and a fixture attachment section; and wherein the attaching member is configured to attach to the attaching member attachment structure at the housing attachment section and to the light fixture at the fixture attachment section.

15. A luminaire according to claim 1 further comprising:

an occupancy sensor having a field of view; and a controller operably coupled to the light source and in communication with the occupancy sensor;

wherein the occupancy sensor is configured to determine whether an object is within the field of view of the occupancy sensor;

wherein the occupancy sensor is configured to transmit a positive indication when an object is determined to be within the field of view; and wherein the controller is configured to operate the light source to illuminate the light source upon receiving the positive indication.

16. A luminaire according to claim 1 further comprising:

a network interface configured to enable communication with a network; and a controller operably coupled to the light source and in communication with the network interface;

wherein the network interface is operable to receive communications across the network and provide an instruction to the controller; and wherein the controller operates the light source responsive to the instruction received from the network interface.

17. A luminaire according to claim 16 wherein the network comprises a plurality of luminaires; wherein the controller is operable to send an instruction to the network interface; and wherein the network interface is operable to transmit the instruction to each of the plurality of luminaires across the network.

18. A luminaire according to claim 17 further comprising an occupancy sensor having a field of view;

wherein the controller is positioned in communication with the occupancy sensor;

wherein the occupancy sensor is configured to determine whether an object is within the field of view of the occupancy sensor;

wherein the occupancy sensor transmits a positive indication when an object is determined to be within the field of view;

wherein the controller is configured to operate the light source responsive to receiving the positive indication;

wherein the controller is configured to transmit an instruction to illuminate the light source upon receiving the positive indication; and wherein the network interface is configured to transmit the instruction to each of the plurality of luminaires across the network.

19. A luminaire according to claim 1 wherein the light source is positioned so as to be obscured from view from any point external the luminaire.

20. A luminaire adapted to be carried by a light fixture comprising:

a housing;

a primary optic disposed within the housing having a reflective inner surface and a generally concave shape defining an optical chamber;

a light source;

a heat sink being generally annular and defining an aperture;

a secondary optic positioned adjacent to the light source; and an attaching member;

wherein the light source is positioned in thermal communication with the heat sink;

wherein light emitted by the light source enters the optical chamber incident upon the reflective inner surface of the primary optic, and is reflected through the aperture of the heat sink member;

wherein the secondary optic is configured to attach to the heat sink and form a seal between the light source and the optical chamber;

wherein the primary optic further comprises an attaching member attachment structure positioned on the outer surface of the primary optic;

wherein the attaching member comprises a housing attachment section and a fixture attachment section; and wherein the attaching member is configured to attach to the attaching member attachment structure at the housing attachment section and to the light fixture at the fixture attachment section.

* * * * *